US007105762B1

(12) United States Patent
Lee

(10) Patent No.: US 7,105,762 B1
(45) Date of Patent: Sep. 12, 2006

(54) ROCKER SWITCH AND ACTUATOR THEREFOR

(75) Inventor: Davin R. Lee, Watertown, WI (US)

(73) Assignee: Eaton Corporation, Cleveland ( * ) Notice: Subject to any disclaimer, the term of this patent is extended or adjusted under 35 U.S.C. 154(b) by 0 days.

(21) Appl. No.: 11/146,957

(22) Filed: Jun. 7, 2005

(51) Int. Cl.
*H01H 5/00* (2006.01)
*H01H 23/00* (2006.01)

(52) U.S. Cl. ..... 200/449; 200/559; 200/339

(58) Field of Classification Search ..... 200/405–408, 200/449, 453, 459–461, 553, 556–559, 339
See application file for complete search history.

(56) References Cited

U.S. PATENT DOCUMENTS 3,246,087 A * 4/1966 Haviland ..... 200/6 R
4,024,367 A 5/1977 Kodaira et al.
4,221,941 A 9/1980 Genovese
4,321,442 A 3/1982 Tanaka et al.
4,528,431 A 7/1985 Coleman, III
4,697,053 A 9/1987 Lockard
5,053,591 A 10/1991 Theurer
5,630,502 A 5/1997 Kurek et al.
5,810,109 A 9/1998 Chu
6,339,201 B1 1/2002 Balaban et al.
6,380,500 B1 4/2002 Lin
6,462,292 B1 * 10/2002 Wang ..... 200/315
6,545,239 B1 4/2003 Spedale et al.
6,576,855 B1 6/2003 Levendis et al.
6,617,535 B1 * 9/2003 Lacroix ..... 200/339
6,670,727 B1 * 12/2003 Lee et al. ..... 307/140
6,734,376 B1 * 5/2004 Ichida et al. ..... 200/4

* cited by examiner

*Primary Examiner*—Michael A. Friedhofer
(74) *Attorney, Agent, or Firm*—Martin J. Moran

(57) ABSTRACT

An actuator assembly is for a short-depth rocker switch including a housing having an opening, a cavity, a base, and a first depth between the opening and base. The actuator assembly includes an operating member having a first end disposed proximate the opening, and a second end extending into the cavity, and, an over-center mechanism disposed proximate the first end of the operating member, distal from the second end of the operating member. The over-center mechanism comprises a one or two-piece shaped element which defines a plurality of operating characteristics of the operating member, and which has a second depth which is less than about 25 percent of the first depth of the housing. This enables the overall depth of the rocker switch to be relatively short in comparison to known designs. A sensor for detecting the position of the second end of the operating member is also disclosed.

13 Claims, 5 Drawing Sheets

ROCKER SWITCH AND ACTUATOR THEREFOR

BACKGROUND OF THE INVENTION

1. Field of the Invention

The present invention relates generally to electrical switching apparatus and, more particularly, to rocker switches. The invention also relates to actuators for rocker switches.

2. Background Information

Rocker switches are generally old and well known in the art. As shown in FIG. 1, a rocker switch 2 generally includes a housing 4 having a first or upper (from the perspective of FIG. 1) portion 6, and a second or lower (from the perspective of FIG. 1) portion 8. The housing 4 is typically made from a non-conductive material, such as a heat-resistant plastic, and is structured to define a cavity 10 therein. Typically, the upper portion 6 of the housing 4 contains an actuator, such the pivotal button or operating member 12, which can be actuated from the exterior of the housing 4. The lower portion 8 of the housing 4 contains a conventional mechanism for conveying a signal that the switch 2 has been actuated. Specifically, when the operating member 12 is actuated, at least one moveable contact 14,16 is moved into or out of engagement with a corresponding stationary contact 18,20 (e.g., moveable contact 14 is engaging stationary contact 18). The stationary contacts 18,20 are in electrical communication with one or more terminals 22,24,26 (e.g., stationary contact 18 is in electrical communication with load terminal 22) at the base 28 of the housing 4. Typically, three terminals are present, with first and third terminals 22,26 being disposed proximate the ends of the switch 2 and comprising load terminals, and a second, middle terminal 24 being a line terminal. Each of the terminals 22,24,26 extends from outside the housing 4 into the cavity 10.

The lower portion 8 of the housing 4 also requires another mechanism or subassembly 30 structured to provide a resistance force in order to create a tactile, "snap" feel of the operating member 12 and to facilitate the switching action when adequate force is applied to the operating member 12. This mechanism is commonly referred to as an "over-center" mechanism 30. Known over-center mechanisms (e.g., 30) typically comprise a separate sub-assembly having a shaped member 32 and a spring member 34, although other configurations (not shown) are possible. The shaped member is usually a deflective conductor 32 which has a specific profile and is structured to pivot and engage the stationary contacts 18,20 electrically connected to the terminals 22,26. The profile of the deflective conductor 32 dictates the operating characteristics (e.g., without limitation, type of action, such as, momentary or sustained; number and location of positions of the operating member; operating forces) of the rocker switch 2. The spring member 34 typically biases a plunger 36 against the deflective conductor 32 which causes the operating member 12 to, for example, be in either of two positions which are on either side of a centered point or position. Of course, it will be understood that the operating member 12 may have more than two positions. The force required to move the operating member 12 from one position to the other position decreases suddenly once the center point of the mechanism 30 has been passed. Hence, the component's "over-center" name. In this manner, the desired snap-type tactile feedback is provided.

However, the foregoing structures take up significant space within the rocker switch 2, particularly in the lower portion 8 of the housing 4. This requires the switch to have considerable depth 38 which is undesirable in many applications where mounting space is limited (e.g. without limitation, in the instrument panel of an airplane).

There is, therefore, room for improvement in rocker switches and in actuators therefor.

SUMMARY OF THE INVENTION

These needs and others are met by the present invention, which is directed to a rocker switch and an improved actuator structure that defines the operating characteristics of the rocker switch while simultaneously reducing the depth of the rocker switch.

As one aspect of the invention, an actuator assembly is for a rocker switch including a housing having an opening and a cavity. The actuator assembly comprises: an operating member operable between a plurality of positions, the operating member including a first end structured to be disposed proximate the opening of the housing of the rocker switch and a second end structured to extend into the cavity of the housing; and a shaped element disposed proximate the first end of the operating member, disposed distal from the second end of the operating member, and structured to cooperate with the first end in order to define a plurality of operating characteristics of the operating member.

The first end of the operating member may comprise a molded switching element having a plurality of protrusions wherein the shaped element is disposed within the confines of the molded switching element and the shaped element is structured to be actuated by at least one of the protrusions of the molded switching element in response to the first end of the operating member being actuated.

The shaped element may be an over-center mechanism wherein the shape of the over-center mechanism defines as the operating characteristics of the operating member, operating characteristics selected from the group consisting of positions of the operating member, actions of the operating member, and operating forces of the operating member. The over-center mechanism may comprise a single-piece shaped element having a first end, a second end, and a pivot disposed therebetween and structured to pivotally engage the housing of the rocker switch. The first end of the operating member may have at least two protrusions structured to engage and actuate the first and second ends, respectively, of the single-piece shaped element. The first and second ends of the single-piece shaped element may include a plurality of deflectable resilient extension members structured to provide feedback to the operating member in response to being deflected upon actuation of the single-piece shaped element by one of the at least two protrusions.

The over-center mechanism may alternatively comprise first and second opposing shaped elements each having a pair of legs structured to pivotally engage the housing of the rocker switch, a generally horizontal portion, and a plurality of deflectable resilient extension members extending from the generally horizontal portion wherein the first end of the operating member includes corresponding protrusions structured to engage and pivot the generally horizontal portion of the corresponding one of the first and second opposing shaped elements thereby deflecting at least one of the deflectable resilient extension members. The at least one of the deflectable resilient extension members may be structured to provide feedback to the operating member, responsive to being deflected.

As another aspect of the invention, an actuator assembly is for a rocker switch including a housing having an opening and a base, a distance between the opening and the base substantially defining a first depth. The actuator assembly comprises: an operating member operable between a plurality of positions and including a first end and a second end, the first end of the operating member structured to be disposed proximate the opening of the housing of the rocker switch, the second end of the operating member structured to extend into the housing toward the base; and an over-center mechanism disposed closer to the first end of the operating member than to the second end and being structured to cooperate with the first end in order to define a plurality of operating characteristics of the operating member, the over-center mechanism having a second depth which is substantially less than the first depth.

The over-center mechanism may comprise an at least one-piece shaped member having as the second depth a depth which is less than about 25% of the first depth of the housing.

As yet another aspect of the invention, a short-depth rocker switch comprises: a housing including an opening and a cavity; a base including a plurality of terminals extending from outside the housing into the cavity therein; and an actuator assembly comprising: an operating member operable between a plurality of positions and including a first end and a second end, the first end of the operating member being disposed at the opening of the housing, the second end of the operating member extending into the cavity of the housing toward the base, a shaped element cooperating with the first end of the operating member in order to define a plurality of operating characteristics of the operating member, the shaped element being disposed distal from the second end of the operating member, and at least one sensor disposed proximate the terminals and adapted to detect the position of the operating member.

The shaped element may be an over-center mechanism wherein the shape of the over-center mechanism defines as the operating characteristics of the operating member, operating characteristics selected from the group consisting of positions of the operating member, actions of the operating member, and operating forces of the operating member. The operating member may have at least two positions wherein each of the at least two of the positions has an operating action selected from the group consisting of sustained and momentary and wherein the shape of the over-center mechanism dictates whether the operating action for each of the at least two of the positions of the operating member is sustained or momentary.

The at least one sensor may be at least one moveable contact structured to be engaged and actuated by the second end of the operating member in response to actuation of the first end of the operating member. Alternatively, the at least one sensor may be a proximity sensor structured to detect the position of the operating member without requiring mechanical contact between the proximity sensor and the operating member.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
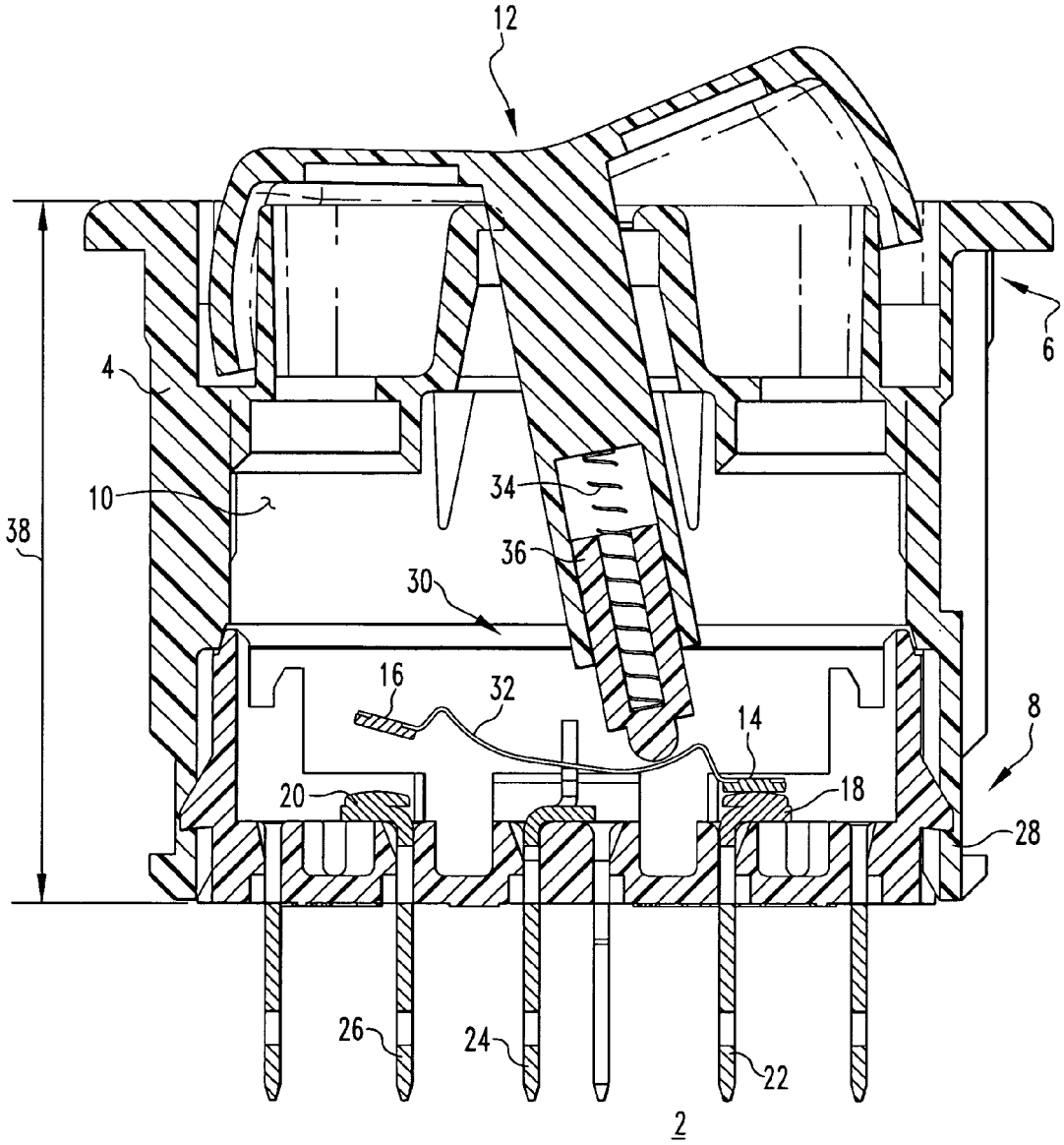
FIG.1 PRIOR ART
FIG. 1 is a cross-sectional side view of a rocker switch assembly.

Directional phrases used herein, such as, for example, left, right, clockwise, counterclockwise and derivatives thereof, relate to the orientation of the elements shown in the drawings and are not limiting upon the claims unless expressly recited therein.

As employed herein, the statement that two or more parts are "coupled" together shall mean that the parts are joined together either directly or joined through one or more intermediate parts.

As employed herein, the term "operating characteristics" refers to the features of a rocker switch, expressly including, but not limited to, the type of operating member, the number of positions of the operating member, the location of positions of the operating member, types of action of the operating member (e.g., sustained, momentary and combinations thereof), operating forces, and the path of movement of the operating member.

As employed herein, the term "switching element" expressly includes, but is not limited to, molded rocker switches, microswitches, rubber key pad switches, snap dome switches, and tactile switches, generally.

As employed herein, the term "sensor" refers to any known or suitable mechanism adapted to detect the position of the exemplary rocker switch operating member and expressly includes, without limitation, mechanical contacts, such as moveable contacts structured to be physically engaged by the second end of the exemplary operating member, as well as "proximity sensors" which are adapted to detect the position of the operating member without requiring contact between the operating member and the sensor. Proximity sensors include, for example, without limitation, optical sensors (e.g., photo eyes; photo-detectors), inductive proximity sensors, capacitive proximity sensors, speed sensors, and other known or suitable non-contact position sensors generally, such as a magnetic proximity sensor structured to detect the position of an operating member modified to include a magnetic element or other suitable target.

As employed herein, the term "feedback" refers to a discrete response, such as, for example, without limitation, a "snap" or similar tactile response provided by the exemplary over-center mechanism and experienced by an operator actuating the operating member, for example, from a first position to a second position. The "feedback" is, therefore, one of the "operating characteristics," as previously defined, which are dictated by the shape and configuration of the exemplary over-center mechanism and shaped element thereof. Accordingly, "feedback" as used herein is generally synonymous with the aforementioned "types of action" of the operating member. For example, as will be discussed herein, a sustained action is typically accompanied by a tactile feedback while a momentary action is not.

Figure 2:
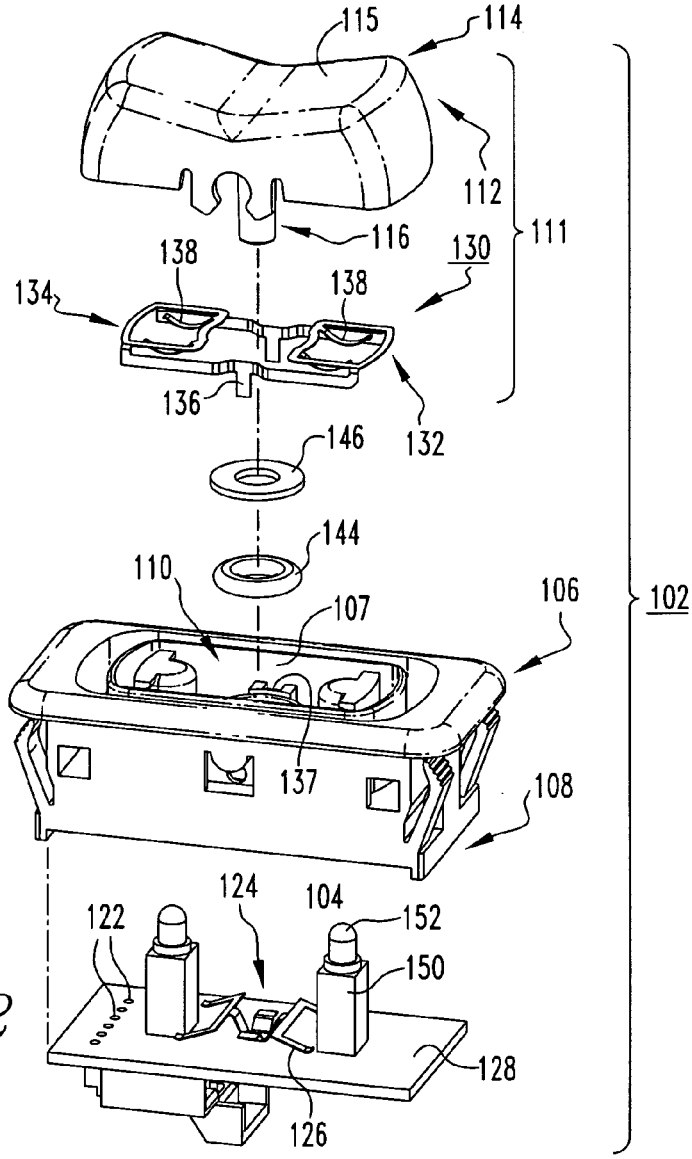
FIG. 2 is an exploded isometric view of a short depth rocker switch and an over-center actuator assembly, in accordance with the invention.

FIG. 2 shows a rocker switch, which is a short-depth rocker switch 102 employing an actuator assembly 111 in accordance with the invention. The rocker switch 102 generally includes a housing 104 having an upper (from the perspective of FIG. 2) portion 106, an opening 107, a lower (from the perspective of FIG. 2) portion 108, and a cavity 110 structured to receive an operating member 112 and the actuator assembly 111 therefor. The rocker switch 102 further includes a base 128 which, in the examples shown and described herein, is a separate member coupled to the lower portion 108 of the rocker switch housing 104. However, it will be appreciated that an integral base (not shown), which comprises an integral portion of the housing 104 rather than a separate component, is also contemplated by the invention.

Figure 4A:
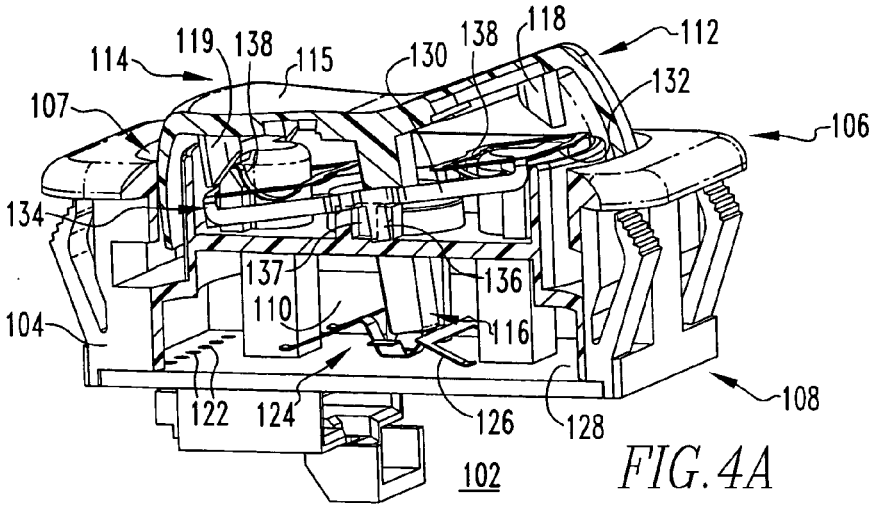
FIGS. 4A and 4B are isometric, partially sectioned views of two positions of the short depth rocker switch and over-center actuator assembly of FIG. 2, each showing sustained actions in accordance with an embodiment of the invention.
Figure 5:
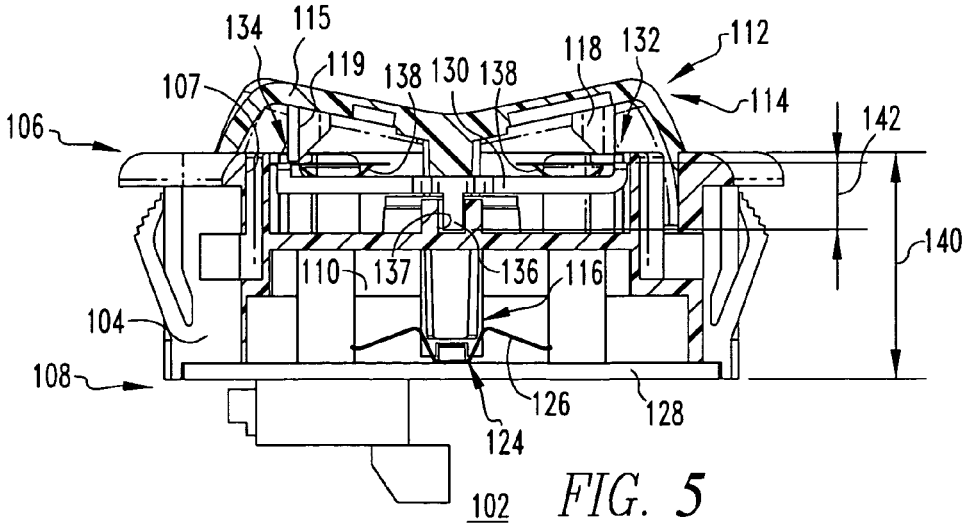
FIG. 5 is a cross-sectional view of the short depth rocker switch and over-center actuator assembly of FIGS. 4A and 4B, but modified to show the operating member in a third, center position.

Referring briefly to FIG. 5, the short-depth nature of the exemplary rocker switch 102 (see also rocker switch 202 of FIGS. 6 and 8), will be discussed. Specifically, the distance between the opening 107 of the housing 104 and the base 128 generally defines a first depth 140 which is much shorter than the depth of known rocker switches (e.g., depth 38 of rocker switch 2 of FIG. 1). Specifically, for the actuator assembly 111 (FIG. 2) or 211 (FIG. 6) of the invention, by eliminating the separate, multi-component (e.g., deflective conductor 32, spring member 34, and plunger 36 of FIG. 1) over-center mechanism 30 at the lower portion 8 of the rocker switch housing 4, as shown in FIG. 1, the depth 38 of the rocker switch 2 is reduced by between about 35 to about 60 percent, and preferably by about 50 percent. This is a highly desirable achievement, particularly with respect to applications in which space is limited, such as, for example, without limitation, the instrument panel of an airplane (not shown). The reduced depth 140 and thus overall size of the rocker switch 102 (FIGS. 2, 4A and 5) or 202 (FIGS. 6 and 8) also advantageously reduces the weight of the switch 102,202. The actuator assembly 111,211, which enables the rocker switch 102,202 to have the aforementioned short depth 140 will now be discussed with reference to FIGS. 2 and 6, respectively.

Figure 3:
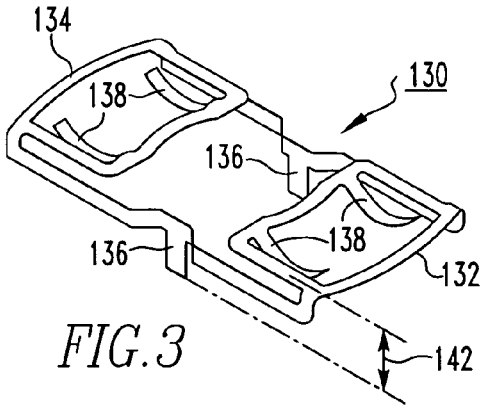
FIG. 3 is an isometric view of the over-center actuator of FIG. 2.
Figure 4B:
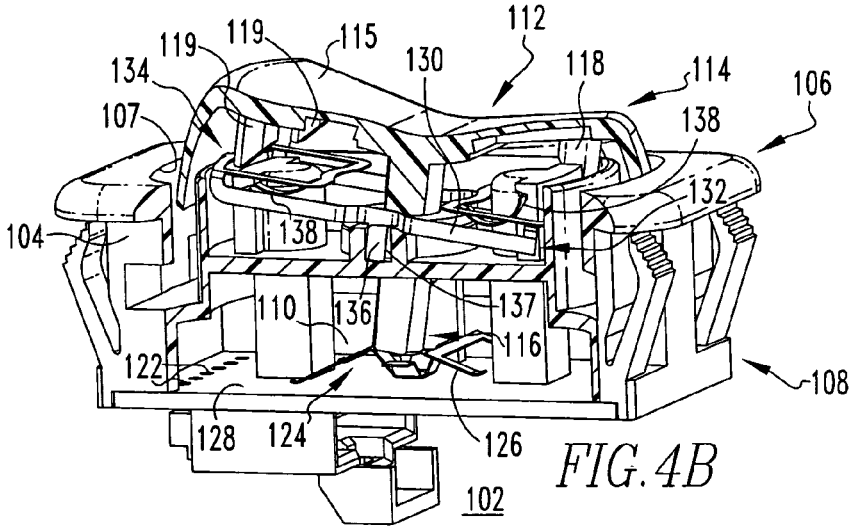
Figure 6:
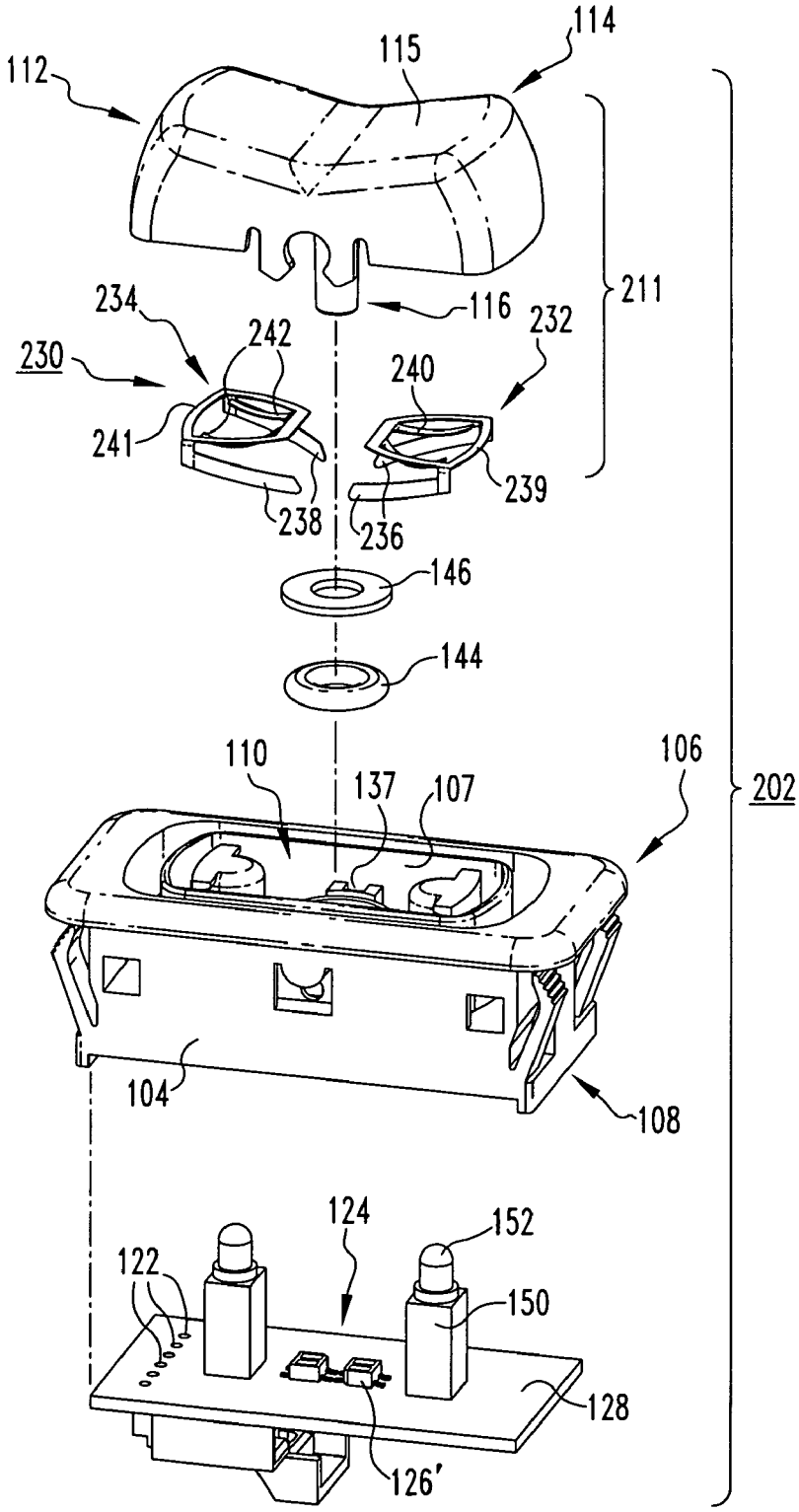
FIG. 6 is an exploded isometric view of a short depth rocker switch and two-piece over-center actuator in accordance with another embodiment of the invention.
Figure 7:
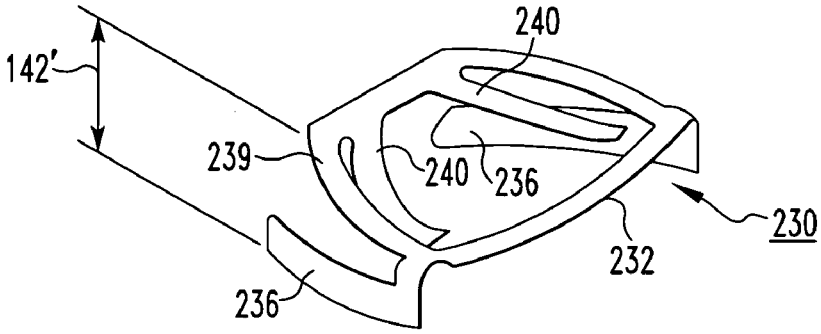
FIG. 7 is an isometric view of one half of the two piece over-center actuator of FIG. 6.
Figure 8:
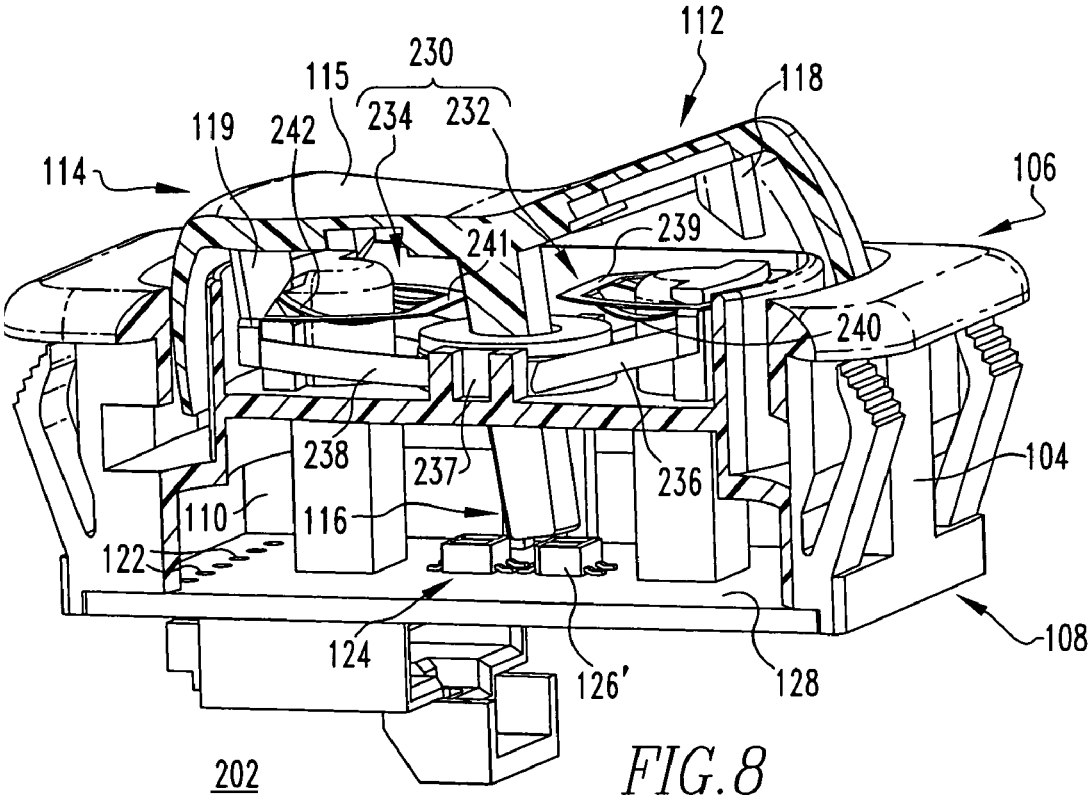
FIG. 8 is an isometric, partially sectioned view of a first position of the short depth rocker switch of FIG. 6.

The actuator assembly 111 (FIG. 2) or 211 (FIG. 6) generally includes the operating member 112 which is operable between a plurality of positions as shown, for example in FIGS. 4A, 4B and 5, and an over-center mechanism 130 (FIGS. 2, 3, 4A, 4B and 5), 230 (FIGS. 6–8). The operating member 112, which is essentially identical for both of the example rocker switches 102,202 shown and described herein, has a first end 114 structured to be disposed proximate the opening 107 of the housing 104, and a second end 116 structured to extend into the cavity 110 of the housing 104 (best shown in FIGS. 4A, 4B, 5 and 8). The term "proximate" is employed herein in accordance with its conventional meaning of near to, or close. In particular, with reference to the over-center mechanisms 130,230, proximate refers to any position on the exemplary operating member 112 wherein the corresponding over-center mechanism 130, 230 is disposed closer to the first end 114 of the operating member 112 than to the second end 116. In the examples shown and described herein, the operating member 112 is a molded switching element 115 and the over-center mechanism 130,230 is substantially disposed within the confines of the molded switching element 115, as best shown in FIGS. 4A, 4B, 5 and 8. However, it will be appreciated other suitable switching element configurations could be employed. Similarly, the over-center mechanism 130 (FIGS. 2, 3, 4A, 4B and 5), 230 (FIGS. 6–8) could have a variety of shapes and configurations other than those illustrated and described herein.

Referring to FIGS. 2, 3, 4A, 4B, 5 and 6–8, respectively, two representative examples of actuator assemblies 111 and 211 are shown. Specifically, actuator assembly 111 of rocker switch 102 of FIGS. 2, 3, 4A, 4B and 5 has a shaped element, which is a single-piece shaped element 130, while actuator assembly 211 for rocker switch 202 of FIGS. 6–8 employs an over-center mechanism 230 which comprises two opposing shaped elements 232,234. Apart from the over-center mechanisms 130,230 and the sensor 124, which will be described below, the remainder of the rocker switch components, such as the housing 104, operating member 112, and base 128 of the exemplary rocker switches 102 (FIGS. 2 and 4A, 4B and 5) and 202 (FIGS. 6 and 8), are essentially the same. In both of the examples, the over-center mechanism 130,230 is disposed proximate the first end 114 of the operating member 112, is disposed distal from the second end 116 of the operating member 112, and is structured to cooperate with the first end 114 in order to define the plurality of operating characteristics of the operating member 112. The shape and configuration of the over-center mechanisms 130,230, which will be described in further detail below, dictate the operating characteristics associated with the corresponding one of the positions of the operating member 112. The operating characteristics expressly include, without limitation, positions of the operating member 112, operating forces of the operating member 112, and types of action of the operating member 112. Additionally, each of the operating member positions has an operating action which is either sustained or momentary. A sustained action is one in which the position of the operating member 112 is maintained until an external force is applied to the operating member 112 in order to overcome it. Conversely, a momentary action is one which is only maintained if a continuous external force is applied to operating member 112. As soon as the force is removed, the operating member 112 will return to a sustained position. In summary, the shape of each of the shaped elements 130,232,234 of the over-center mechanisms 130,230 dictates whether the operating actions for the corresponding operating member positions, will be sustained or momentary. Rocker switch operating characteristics, including various representative rocker switch applications in which a particular type of operating characteristic is desirable, are described in further detail in co-pending U.S. patent application Ser. No. 11/023,235, entitled "Self-Contained Actuator Subassembly For a Rocker Switch and Rocker Switch Employing the Same," which is incorporated herein by reference.

FIG. 3 shows over-center mechanism 130, which comprises a single-piece shaped element having a first end 132, a second end 134, and a pivot 136 disposed between the first and second ends 132,134. The pivot 136 is structured to pivotally engage the housing 104 (FIG. 2) of the rocker switch 102 (FIG. 2). Specifically, as best shown in FIGS. 4A, 4B and 5, the exemplary housing 104 includes a molded recess 137 structured to receive the pivot 136. The first and second ends 132,134 of the single-piece shaped element 130 include a plurality of deflectable resilient extension members 138 which are structured to provide feedback to the operating member 112 in response to being deflected by protrusions 118,119 (FIGS. 4A, 4B, 5 and 8) of the operating member 112. In the example of FIG. 3, each end 132,134 of the single-piece shaped element 130 includes two deflectable resilient extension members 138, which are curved, and which extend outward (from the perspective of FIG. 3) toward the corresponding end 132,134. The single-piece shaped element 130 also has a second depth 142 which is generally defined by the distance between the bottom of the pivot 136 and the top of the first and second ends 132,134, as shown.

FIGS. 4A, 4B and 5 show the rocker switch 102 employing the over-center mechanism 130, which is adapted to provide the operating member 112 with three sustained operating positions, a first position in which the over-center mechanism 130 and operating member 112 pivot counterclockwise about pivot 136 to the left sustained position shown in FIG. 4A, a second position in which the over-center mechanism 130 and operating member 112 pivot clockwise about pivot 136 to the right sustained position of FIG. 4B, and a third, neutral or OFF sustained position (FIG. 5). The forgoing operating member positions may correspond, for example, without limitation, to a forward operating mode of an electrical apparatus (not shown) in which the rocker switch 102 is installed, a reverse operating mode, and a neutral or OFF position, respectively. As previously discussed, the shape and configuration of the exemplary single-piece shaped element 130 advantageously dictates the foregoing operating member 112 operating characteristics without requiring a separate over-center mechanism assembly (e.g., over-center mechanism 30 and deflective conductor 32, spring member 34, and plunger 36, thereof of FIG. 1). Accordingly, in addition to simplifying the over-center mechanism 130, the invention eliminates the multiple components of assembly 30 (FIG. 1) which required substantial space at the lower portion 108 of the rocker switch housing 104.

As best shown in FIG. 5, the second depth 142 of the exemplary over-center mechanism 130 is substantially less than the first depth 140 of the housing 104. More specifically, the second depth 142 is less than about 25 percent of the first depth 140 of housing 104. This is also true for the second depth 142' (FIG. 7) of the two-piece over-center mechanism 230 example of FIGS. 6–8, discussed below. The compact design of the over-center mechanisms 130,230 of the invention is, as previously discussed, responsible for the greatly reduced first depth 140 of the exemplary rocker switch housing 104 in comparison with known rocker switch housings (e.g., depth 38 of housing 4 of FIG. 1).

In the examples shown and described herein, the base 128 of the rocker switch 102 (FIGS. 2 and 4A, 4B and 5) or 202 (FIGS. 6 and 8) includes a plurality of terminals 122 (shown in simplified form for simplicity of disclosure) that extend from outside the housing 104 into the cavity 110 therein. The exemplary rocker switches 102,202 further include at least one sensor 124 disposed proximate the terminals 122 and adapted to detect the position of the operating member 112. Specifically, in the example of FIGS. 4A, 4B and 5, the at least one sensor 124 is a moveable contact 126 structured to be engaged and actuated (e.g., pivoted) by the second end 116 of the operating member 112 in response to actuation of the first end 114 of the operating member 112. For instance, in FIG. 4A, the operating member 112 is shown in the left sustained position corresponding to the second end 114 of the operating member 112 engaging and pivoting the moveable contact 126 clockwise in order to contact and be in electrical communication with, for example, a copper trace (not shown) or other suitable electrical contact element (not shown) disposed on the base 128. The electrical contact element is electrically, conductively connected to one or more of the terminals 122. Thus, as will be understood with reference to FIG. 4A, in operation, an actuation of the first end 114 of the operating member 112 results in the protrusion 119 of the operating member 112 engaging and pivoting the corresponding end (e.g., second end 134) of the over-center mechanism 130 about pivot 136. In response, the exemplary deflectable resilient extension members 138 engage a portion of the housing 104, as shown, and are deflected upwards (from the perspective of FIG. 4A), thereby snapping into the position shown and providing a tactile feedback to the operating member 112. The operating member 112 then maintains the sustained first position shown. Operation of the operating member 112 in the opposite direction, as shown in FIG. 4B, is essentially the same with the corresponding protrusion 118 engaging the first end 132 of the exemplary over-center mechanism 130, as shown. This results in the second end 116 of the operating member 112 engaging and pivoting the exemplary moveable contact 126 into electrical communication with one or more of the terminals 122. Finally, in the neutral or OFF position shown in FIG. 5, it will be appreciated that none of the protrusions 118,119 are engaging the exemplary over-center mechanism 130 and, therefore, the second end 116 of the operating member 112 is in a central position in which it is not pivoting the moveable contact 126. As previously discussed, it will be appreciated that a wide variety of alternative over-center mechanism designs and configurations can be employed to provide the rocker switch (e.g., 102) with a wide array of operating characteristics other than those shown and described herein.

For example, as shown in FIGS. 6–8, the over-center mechanism 230 consists of two opposing shaped elements 232,234 rather than the single-piece shaped element 130 of FIGS. 2, 3 4A, 4B and 5. In the example of FIGS. 6–8, each of the first and second opposing shaped elements 232,234 has a pair of legs 236,238 (FIGS. 6 and 8) structured to pivotally engage the housing 104 of the rocker switch 202. However, rather than including a pivot, such as pivot 136 of single-piece shaped element 130 of FIG. 3, the legs 236,238 of the first and second opposing shaped elements 232,234 merely engage either side of the exemplary pivot recess 137, as best shown in FIG. 8. Like the aforementioned single-piece shaped element 130, both of the opposing shaped elements 232,234 include a plurality of deflectable resilient extension members 240,242, which extend, respectively, from a generally horizontal portion 239,241. The exemplary first and second opposing shaped elements 232,234 each include two curved deflectable resilient extension members 240,242 which, in the example shown and described herein, extend from an inner end of the shaped element, outward.

Referring now to FIG. 8, it will be understood that the over-center mechanism 230 functions in substantially the same manner and performs substantially the same function as the over-center mechanism 130 of FIGS. 4A, 4B and 5. For example, FIG. 8 is comparable to FIG. 4A in that the first end 114 of the operating member 112 has been actuated to the left such that the protrusion 119 engages the second opposing shaped element 234, pivoting it counterclockwise (with respect to FIG. 8) by way of leg 238 and resulting in the deflection of extension 242 until a tactile feedback is produced. However, as previously discussed in connection with FIGS. 4A, 4B and 5, it will be appreciated that other over-center mechanism designs and configurations could be employed to provide a wide variety of alternative operating member operating characteristics without departing from the scope of the invention. It will also be appreciated that, as shown in FIG. 8, the over-center mechanisms 130,230 of the invention may be employed with a wide variety of different rocker switches and different rocker switch components, such as the proximity sensor 126', shown. Any known or suitable proximity sensor 126', such as those previously described, could be employed instead of the moveable contact 126 shown and described with respect to FIGS. 2 and 4A, 4B and 5. Such a proximity sensor (e.g., 126') is generally structured to detect the position of the operating member 112 and, in particular, the second end 116 of the operating member 112, without requiring mechanical contact between the proximity sensor 126' and the operating member 112. It will also be appreciated that the rocker switch 102,202 may include a variety of other features which are not limiting upon the invention. For example, the rocker switch 102,202 may incorporate known features such as a plurality of light pipes 150 (FIGS. 2 and 6) each having a light, such as a light emitting diode (LED) 152 (FIGS. 2 and 6), structured to illuminate a corresponding portion of the first end 114 of the operating member 112. Additionally, as shown in FIGS. 2 and 6, components such as a seal 144 and seal washer 146, which may be made from any known or suitable material, such as a resilient rubber material, can be employed in any suitable configuration, in order to further facilitate operation (e.g., pivoting) of the exemplary actuator assembly 111,211 and operating member 112 thereof. Accordingly, the present invention provides an actuator assembly which includes a simplified, compact and efficient over-center mechanism structured to customize the operating characteristics of the rocker switch while simultaneously significantly reducing the overall depth of the rocker switch.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. An actuator assembly for a rocker switch including a housing having an opening and a base, a distance between said opening and said base substantially defining a first depth, said actuator assembly comprising:

an operating member operable between a plurality of positions and including a first end and a second end, the first end of said operating member structured to be disposed proximate the opening of said housing of said rocker switch, the second end of said operating member structured to extend into said housing toward said base; and an over-center mechanism disposed closer to the first end of said operating member than to the second end and being structured to cooperate with the first end in order to define a plurality of operating characteristics of said operating member, said over-center mechanism having a second depth which is substantially less than said first depth.

2. The actuator assembly of claim 1 wherein said over-center mechanism comprises an at least one-piece shaped member having as said second depth a depth which is less than about 25% of said first depth of said housing.

3. An actuator assembly for a rocker switch including a housing having an opening and a cavity, said actuator assembly comprising:

an operating member operable between a plurality of positions, said operating member including a first end structured to be disposed proximate the opening of said housing of said rocker switch and a second end structured to extend into the cavity of said housing;

a shaped element disposed proximate the first end of said operating member, disposed distal from the second end of said operating member, and structured to cooperate with the first end in order to define a plurality of operating characteristics of said operating member; and wherein the first end of said operating member comprises a molded switching element having a plurality of protrusions; wherein said shaped element is disposed within the confines of said molded switching element; and wherein said shaped element is structured to be actuated by at least one of said protrusions of said molded switching element in response to the first end of said operating member being actuated.

4. An actuator assembly for a rocker switch including a housing having an opening and a cavity, said actuator assembly comprising:

an operating member operable between a plurality of positions, said operating member including a first end structured to be disposed proximate the opening of said housing of said rocker switch and a second end structured to extend into the cavity of said housing;

a shaped element disposed proximate the first end of said operating member, disposed distal from the second end of said operating member, and structured to cooperate with the first end in order to define a plurality of operating characteristics of said operating member;

wherein said shaped element is an over-center mechanism; and wherein the shape of said over-center mechanism defines as said operating characteristics of said operating member, operating characteristics selected from the group consisting of positions of said operating member, actions of said operating member, and operating forces of said operating member; and wherein said over-center mechanism comprises a single-piece shaped element having a first end, a second end, and a pivot disposed between the first and second ends of said single piece shaped element and structured to pivotally engage said housing of said rocker switch; and wherein the first end of said operating member has at least two protrusions structured to engage and actuate the first and second ends, respectively, of said single-piece shaped element.

5. The actuator assembly of claim 4 wherein the first and second ends of said single-piece shaped element include a plurality of deflectable resilient extension members structured to provide feedback to said operating member in response to being deflected upon actuation of said single-piece shaped element by one of said at least two protrusions.

6. An actuator assembly for a rocker switch including a housing having an opening and a cavity, said actuator assembly comprising:

an operating member operable between a plurality of positions, said operating member including a first end structured to be disposed proximate the opening of said housing of said rocker switch and a second end structured to extend into the cavity of said housing;

a shaped element disposed proximate the first end of said operating member, disposed distal from the second end of said operating member, and structured to cooperate with the first end in order to define a plurality of operating characteristics of said operating member;

wherein said shaped element is an over-center mechanism; and wherein the shape of said over-center mechanism defines as said operating characteristics of said operating member, operating characteristics selected from the group consisting of positions of said operating member, actions of said operating member, and operating forces of said operating member; and wherein said over-center mechanism comprises first and second opposing shaped elements each having a pair of legs structured to pivotally engage said housing of said rocker switch, a generally horizontal portion, and a plurality of deflectable resilient extension members extending from said generally horizontal portion; wherein the first end of said operating member includes corresponding protrusions structured to engage and pivot the generally horizontal portion of the corresponding one of said first and second opposing shaped elements thereby deflecting at least one of said deflectable resilient extension members; and wherein said at least one of said deflectable resilient extension members is structured to provide feedback to said operating member, responsive to being deflected.

7. A short-depth rocker switch comprising:

a housing including an opening and a cavity;

a base including a plurality of terminals extending from outside said housing into said cavity therein;

an actuator assembly comprising:

an operating member operable between a plurality of positions and including a first end and a second end, the first end of said operating member being disposed at the opening of said housing, the second end of said operating member extending into the cavity of said housing toward said base, a shaped element cooperating with the first end of said operating member in order to define a plurality of operating characteristics of said operating member, said shaped element being disposed distal from the second end of said operating member, at least one sensor disposed proximate said terminals and adapted to detect the position of said operating member; and wherein the distance between said opening and said base substantially defines a first depth; wherein said shaped element is an over-center mechanism having a second depth; and wherein said second depth of said shaped element is substantially less than said first depth.

8. A short-depth rocker switch comprising:

a housing including an opening and a cavity;

a base including a plurality of terminals extending from outside said housing into said cavity therein;

an actuator assembly comprising:

an operating member operable between a plurality of positions and including a first end and a second end, the first end of said operating member being disposed at the opening of said housing, the second end of said operating member extending into the cavity of said housing toward said base, a shaped element cooperating with the first end of said operating member in order to define a plurality of operating characteristics of said operating member, said shaped element being disposed distal from the second end of said operating member, at least one sensor disposed proximate said terminals and adapted to detect the position of said operating member; and wherein the first end of said operating member comprises a molded switching element having a plurality of protrusions; wherein said shaped element is disposed within the confines of said molded switching element; and wherein said shaped element is structured to be actuated by at least one of said protrusions of said molded switching element in response to the first end of said operating member being actuated.

9. A short-depth rocker switch comprising;

a housing including an opening and a cavity;

a base including a plurality of terminals extending from outside said housing into said cavity therein;

an actuator assembly comprising:

an operating member operable between a plurality of positions and including a first end and a second end, the first end of said operating member being disposed at the opening of said housing, the second end of said operating member extending into the cavity of said housing toward said base, a shaped element cooperating with the first end of said operating member in order to define a plurality of operating characteristics of said operating member, said shaped element being disposed distal from the second end of said operating member, at least one sensor disposed proximate said terminals and adapted to detect the position of said operating member;

wherein said shaped element is an over-center mechanism; and wherein the shape of said over-center mechanism defines as said operating characteristics of said operating member, operating characteristics selected from the group consisting of positions of said operating member, actions of said operating member, and operating forces of said operating member; and wherein said over-center mechanism comprises a single-piece shaped element having a first end, a second end, and a pivot which is disposed between the first and second ends of said single-piece shaped element and which pivotally engages said housing of said rocker switch; and wherein the first end of said operating member has corresponding protrusions structured to engage and actuate the first and second ends, respectively, of said single-piece shaped element.

10. A short-depth rocker switch comprising:

a housing including an opening and a cavity;

a base including a plurality of terminals extending from outside said housing into said cavity therein;

an actuator assembly comprising:

an operating member operable between a plurality of positions and including a first end and a second end, the first end of said operating member being disposed at the opening of said housing, the second end of said operating member extending into the cavity of said housing toward said base, a shaped element cooperating with the first end of said operating member in order to define a plurality of operating characteristics of said operating member, said shaped element being disposed distal from the second end of said operating member, at least one sensor disposed proximate said terminals and adapted to detect the position of said operating member;

wherein said shaped element is an over-center mechanism; and wherein the shape of said over-center mechanism defines as said operating characteristics of said operating member, operating characteristics selected from the group consisting of positions of said operating member, actions of said operating member, and operating forces of said operating member; and wherein said over-center mechanism includes a plurality of deflectable resilient extension members for providing a spring force to said operating member in response to being deflected upon actuation of said over-center mechanism by said corresponding protrusion.

11. The short-depth rocker switch of claim 10 wherein said resilient elements are structured to provide tactile feedback to said operating member in response to actuation of said operating member.

12. A short-depth rocker switch comprising:

a housing including an opening and a cavity;

a base including a plurality of terminals extending from outside said housing into said cavity therein;

an actuator assembly comprising:

an operating member operable between a plurality of positions and including a first end and a second end, the first end of said operating member being disposed at the opening of said housing, the second end of said operating member extending into the cavity of said housing toward said base, a shaped element cooperating with the first end of said operating member in order to define a plurality of operating characteristics of said operating member, said shaped element being disposed distal from the second end of said operating member, at least one sensor disposed proximate said terminals and adapted to detect the position of said operating member;

wherein said shaped element is an over-center mechanism; and wherein the shape of said over-center mechanism defines as said operating characteristics of said operating member, operating characteristics selected from the group consisting of positions of said operating member, actions of said operating member, and operating forces of said operating member; and wherein said over-center mechanism comprises first and second opposing shaped elements each having a pair of legs which pivotally engage said housing of said rocker switch, a generally horizontal portion, and a plurality of deflectable resilient extension members extending from said generally horizontal portions; wherein the first end of said operating member includes corresponding protrusions structured to engage and pivot the generally horizontal portions of the corresponding one of said first and second opposing shaped elements thereby deflecting at least one of said deflectable resilient extension members; and wherein said at least one of said deflectable resilient extension members is structured to provide feedback to said operating member, responsive to being deflected.

13. A short-depth rocker switch comprising:

a housing including an opening and a cavity;

a base including a plurality of terminals extending from outside said housing into said cavity therein;

an actuator assembly comprising:

an operating member operable between a plurality of positions and including a first end and a second end, the first end of said operating member being disposed at the opening of said housing, the second end of said operating member extending into the cavity of said housing toward said base, a shaped element cooperating with the first end of said operating member in order to define a plurality of operating characteristics of said operating member, said shaped element being disposed distal from the second end of said operating member, at least one sensor disposed proximate said terminals and adapted to detect the position of said operating member; and wherein said housing includes a seal and a seal washer disposed between the first and second ends of said operating member proximate said shaped element.

* * * * *